US008069800B2

(12) United States Patent
Philippe et al.

(10) Patent No.: US 8,069,800 B2
(45) Date of Patent: Dec. 6, 2011

(54) STEALTH ARMED SURFACE SHIP

(75) Inventors: Serge Philippe, Lorient (FR); Philippe Goubault, Lorient (FR); Yves Mervin, Lorient (FR); Claudia Bardes, L'Armor Plage (FR); Christian Le Gac, Guidel (FR)

(73) Assignee: DCNS, Paris (FR)

( * ) Notice: Subject to any disclaimer, the term of this patent is extended or adjusted under 35 U.S.C. 154(b) by 747 days.

(21) Appl. No.: 12/064,668

(22) PCT Filed: Aug. 10, 2006

(86) PCT No.: PCT/FR2006/001942

§ 371 (c)(1),
(2), (4) Date: Feb. 25, 2008

(87) PCT Pub. No.: WO2004/023218

PCT Pub. Date: Mar. 1, 2007

(65) Prior Publication Data

US 2008/0216727 A1 Sep. 11, 2008

(30) Foreign Application Priority Data

Aug. 26, 2005 (FR) ..... 05 08787

(51) Int. Cl.

| | |
|---|---|
| ***B63G 13/02*** | (2006.01) |
| ***B63G 9/00*** | (2006.01) |
| ***B63B 1/04*** | (2006.01) |
| ***B63B 1/06*** | (2006.01) |
| ***B63B 1/10*** | (2006.01) |
| ***B63B 3/09*** | (2006.01) |
| ***B63B 15/00*** | (2006.01) |

(52) U.S. Cl. ..... 114/15; 114/56.1; 114/61.1; 114/61.2; 114/61.27; 114/65 R; 89/36.12

(58) Field of Classification Search ..... 114/9, 14, 114/15, 56.1, 61.1, 65 R, 79 R, 355, 61.2, 114/61.27, 283, 288, 356; 89/36.12; 428/919
See application file for complete search history.

(56) References Cited

U.S. PATENT DOCUMENTS 1,310,533 A * 7/1919 Karton ..... 114/15
(Continued)

FOREIGN PATENT DOCUMENTS

DE 3545343 6/1987
(Continued)

OTHER PUBLICATIONS

Machine-assisted English translation of De 4341939 Al.*

(Continued)

*Primary Examiner* — Ajay Vasudeva
(74) *Attorney, Agent, or Firm* — Young & Thompson

(57) ABSTRACT

The invention relates to an armed stealth surface vessel (1) comprising a hull (2), a deck (5, 6) and superstructures (3). The inventive vessel is equipped with sensors, transmitters, arms and, optionally, handling means. The invention is characterized in that the outer casing (4) of the deadworks comprises walls which are all inclined inwards such that the outer faces thereof are oriented upwards and form an angle that is greater than or equal to 20° with the vertical at least above a line located 5 m above the waterline and, along at least 50% of the length of the vessel, above a line located less than one meter above the waterline. The invention is also characterized in that that the essentially-vertical joint lines between two adjacent walls are inclined inwards and form an angle of more than 20° with the vertical. The invention is further characterized in that the sensors and transmitters, the arms and the handling means are concealed or can be concealed in or under the outer casing of the deadworks.

22 Claims, 10 Drawing Sheets

U.S. PATENT DOCUMENTS

| | | | | |
|---|---|---|---|---|
| 1,342,064 | A * | 6/1920 | Petrusavage | 114/10 |
| 5,832,856 | A | 11/1998 | Giles | |
| 6,583,749 | B2 * | 6/2003 | Aknin | 342/2 |
| 6,883,450 | B2 * | 4/2005 | Kingsbury | 114/61.1 |
| 7,032,830 | B2 * | 4/2006 | Ekelöf | 239/8 |
| 2003/0011504 | A1 | 1/2003 | Aknin | |
| 2004/0140150 | A1 | 7/2004 | Strassgurtl et al. | |
| 2004/0182298 | A1 * | 9/2004 | Schmidt et al. | 114/248 |
| 2005/0145159 | A1 | 7/2005 | Barsoum | |

FOREIGN PATENT DOCUMENTS

| | | | |
|---|---|---|---|
| DE | 3706781 | A1 * | 9/1988 |
| DE | 4417484 | | 12/1994 |
| DE | 4341939 | A1 * | 6/1995 |
| DE | 10057427 | A1 * | 1/2002 |
| DE | 10330546 | | 2/2005 |
| EP | 221469 | A1 * | 5/1987 |
| FR | 2533192 | | 12/1984 |
| GB | 2319594 | A * | 5/1998 |
| JP | 61125990 | | 6/1986 |
| JP | 2005125985 | A * | 5/2005 |

OTHER PUBLICATIONS

Mraz S J, "Stealth Stalks the high seas. The sea wraith combines several stealth technologies with the latest advances in weapon and hull design", Machine Design, May 22, 1997, vol. 69, No. 10, pp. 40, 42, 44, Penton Media, Cleveland, OH, US.

* cited by examiner

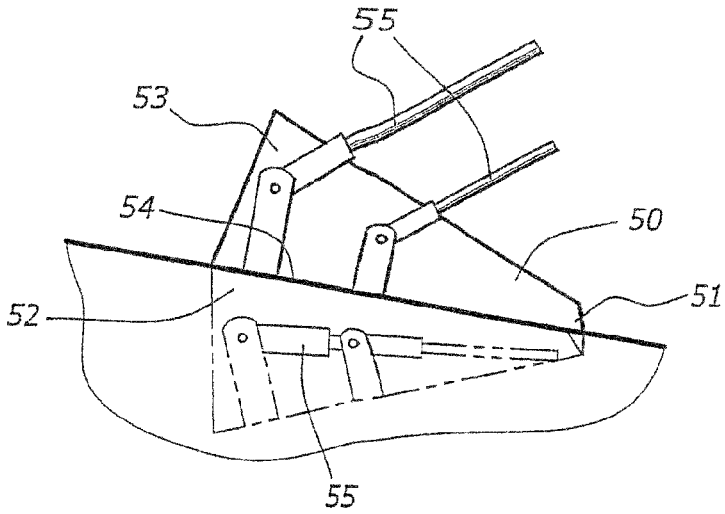
FIG.6
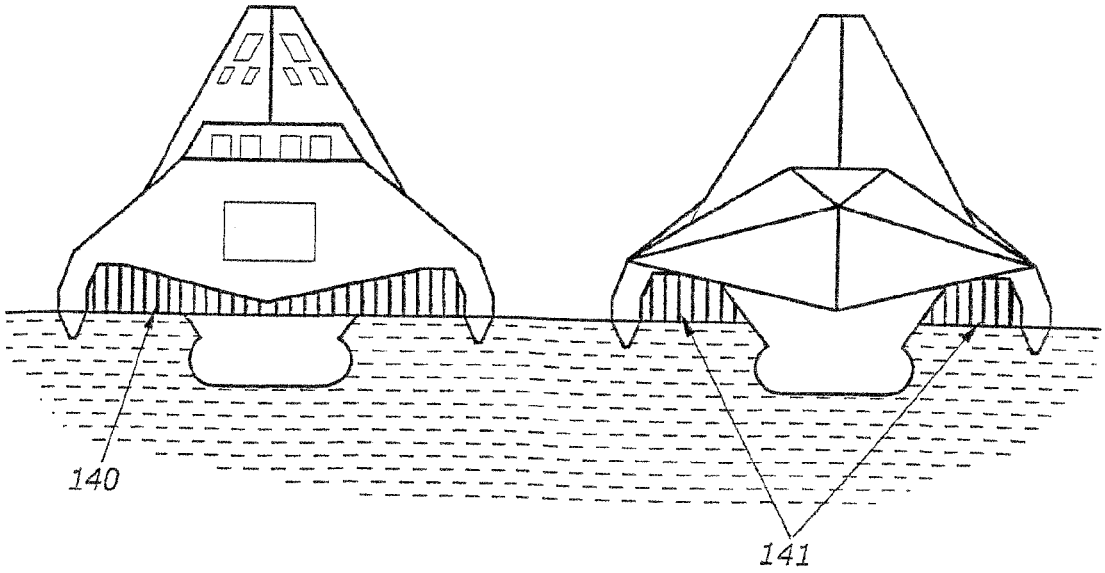
FIG.7A
FIG.7B

STEALTH ARMED SURFACE SHIP

The present invention relates to a stealth armed surface ship comprising a hull, at least one deck, and at least one superstructure, which ship is equipped with sensors and transmitters, with weapons, and optionally with load-handling means.

Stealth naval ships are known, in particular the French frigate Lafayette which was one of the first stealth naval ships to be built, and for which the stealth was obtained by using freeboard sides that were continuous and that tumbled home slightly, by about 10°, above the broken line between the superstructures and the immersed portion of the hull, and by using covered maneuver areas, and absorbent materials and walls.

On such ships, the stealth is essentially electromagnetic stealth, i.e. stealth relative to detection by radar.

Following on from the French frigate Lafayette, proposals have been made for ships offering increasing levels of stealth and in particular that are increasingly difficult to detect by radar, such ships being characterized by freeboard sides that are continuous and that tumble home at angles approximately in the range 10° to 15°, and by masting that is integrated. Unfortunately, the stealth that is sought for such ships is limited in particular because, with conventional hulls, it is not possible to obtain good roll-stability for the ship with large amounts of tumblehome, and because they have numerous items of equipment that increase their radar signatures.

Admittedly, proposals have been made for ships of the catamaran type having considerable amounts of tumblehome, but those ships are of small size and, in fact, they are demonstrators, that, in view of their designs, are unsuitable for an armed ship of large size.

The problem of obtaining armed ships of significant size that have very high stealth, with not only radar signatures but also thermal and optical signatures that blend into their surrounding environments thus remains unsolved.

An object of the present invention is to remedy that drawback by proposing an armed ship whose size can be larger than the size of a frigate, and, for example, can be as large as about 30,000 metric tonnes, that has particularly high stealth as regards electromagnetic, thermal, optical, or even acoustic detection.

Such a ship should, in addition to its stealth, have high operational capacities, and, in particular, be capable of carrying significant weapons equipment or significant equipment of the aircraft type.

To this end, the invention provides a stealth armed surface ship comprising a hull, at least one deck, and at least one superstructure, which ship is equipped with sensors and transmitters, with weapons, and optionally with load-handling means, in which ship the outer casing of the upperworks is constituted by walls that are all inclined inwards so that their outside faces face upwards at angles relative to the vertical that are greater than or equal to 20°, above a line situated 5 meters (m) above the waterline, and at least over 50% of the length of the ship, starting from a line situated less than one meter above the waterline, and, better still, over two-thirds of the length of the ship, in which ship, instead of being vertical as they are generally, the junction lines along which two adjacent walls meet are inclined inwards at angles relative to the vertical that are greater than 20°, and in which ship the sensors and transmitters, the weapons, and the load-handling means are concealed or can be concealed in or beneath the outer casing of the upperworks.

Preferably, the portion of the outer casing that corresponds to the upper half of the hull, including the bow and the stern, is constituted by walls that are all inclined inwards at angles greater than 50°.

Preferably, the portion of the outer casing that corresponds to the superstructures is constituted by walls that are all inclined inwards at angles greater than 30°.

Preferably, the superstructures are disposed in the central third of the length of the hull in a manner such that they are substantially centered along the length, and the angles of the bow lines and of the stern lines are symmetrical about the middle of the hull.

Preferably, the walls making up the outer casing of the upperworks are plane panels, and the junction lines along which two adjacent panels meet are straight. Preferably, at least 60%, better still at least 70%, better still at least 80%, and even better still at least 90% of the developed surface area of the upperworks is constituted by plane panels.

For example, the superstructure is constituted by a pyramid.

The upper portion of the superstructure may contain sensors and/or transmitters that are housed and concealed under a radome, and/or that are constituted by plane panels that are incorporated in the walls of the superstructure.

The superstructure may, at its base, include the bridge, which is preferably a bridge offering 360° vision.

The ship may also include sensors and/or transmitters concealed beneath the walls or incorporated into the walls of the upperworks of the hull.

The ship may have at least one internal compartment that can open to the outside via at least one door integrated in a panel of the outer casing of the upperworks, which compartment is equipped with a deployable gantry making it possible to launch an object such as a watercraft and to bring it back on board.

The ship may be provided with at least one weapon chosen from among a retractable long-range gun, a retractable self-defense turret, a retractable missile launch device, and a retractable torpedo launch device.

The deck may have a sufficiently large area to receive an aircraft such as a helicopter, and optionally means for retracting at least one aircraft into a hangar under the deck.

The ship may be provided with a set of nozzles making it possible to generate a mist enshrouding the upperworks. Preferably, the characteristics of the water are adapted to optimize the stealth of the ship.

Preferably, no noisy power generation means and no noisy means for driving the propulsion means are disposed below the waterline in the ship.

The ship may include at least two parallel floats defining a tunnel between them, the walls of the tunnel extending downwards at angles relative the vertical that are greater than 10°, and the ship includes at least one fuel-burning power source discharging combustion gases, and the combustion gases are discharged into at least one tunnel defined by two parallel floats.

At least one tunnel may be closed at its bow end and at its stern end by respective curtains of water in order to form a screen to radar waves and in order to trap the hot exhaust gases.

The exhaust gases are discharged via at least one exhaust duct whose outlet is provided, at its periphery, with means for generating a shroud constituted by jets of water for channeling the exhaust gases to the surface of the water on which the ship floats.

The ship may have a central main float and at least two stabilizer side floats.

At least one side float may include a keel extended at least above the water into register with the living quarters of the ship, and, at least in register with the living quarters of the ship, the keel contains a ballast compartment that can be filled with water in order to constitute shielding.

Preferably, the center of flotation of the hull is situated forward of its center of buoyancy, and the horizontal distance between the centre of buoyancy and the center of flotation is greater than 5% of the length of the waterplane of the hull.

At least the hull may be made up of non-metallic panels of composite material.

At least some of the walls of the upperworks may be made of or coated with a material having a specific function, in particular of the type absorbing radar waves and/or absorbing infrared radiation, and/or being decharacterizing relative to the surrounding environment.

For example, the ship may be a frigate.

The invention is described more precisely but non-limitingly below with reference to the accompanying figures, in which.

Figure 2A:
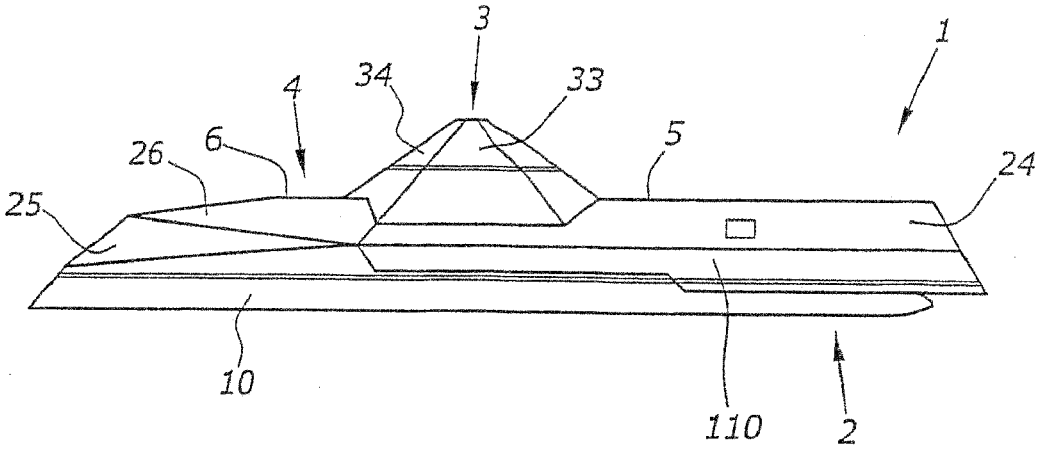
Figure 2B:
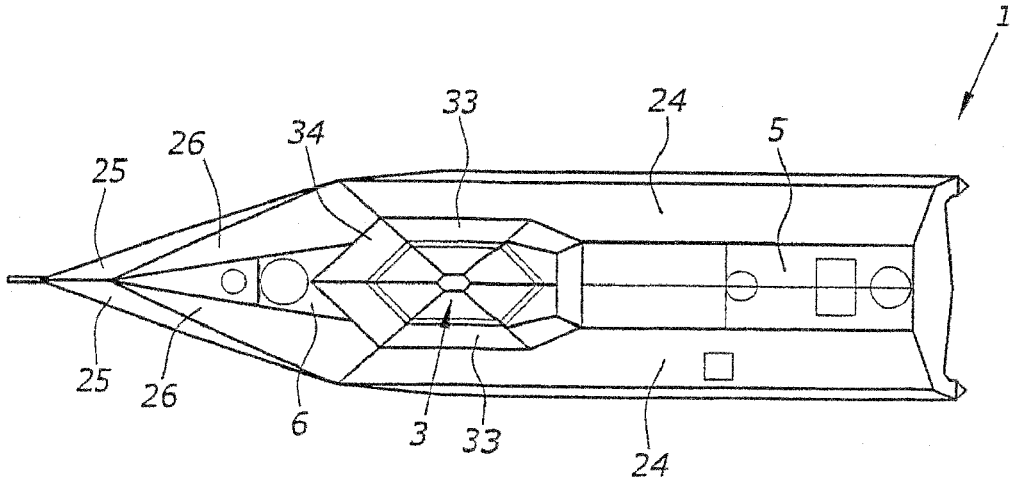
Figure 2C:
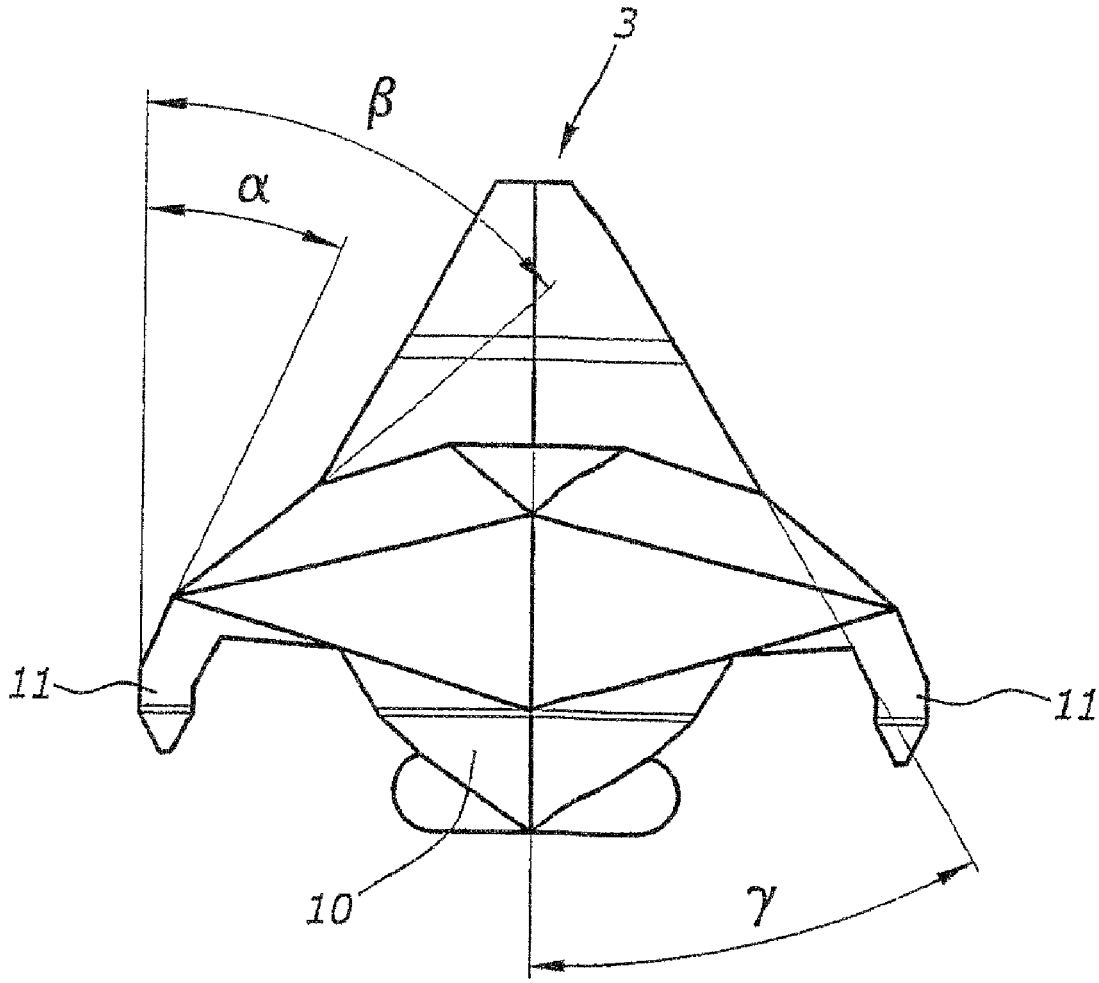
Figure 3:
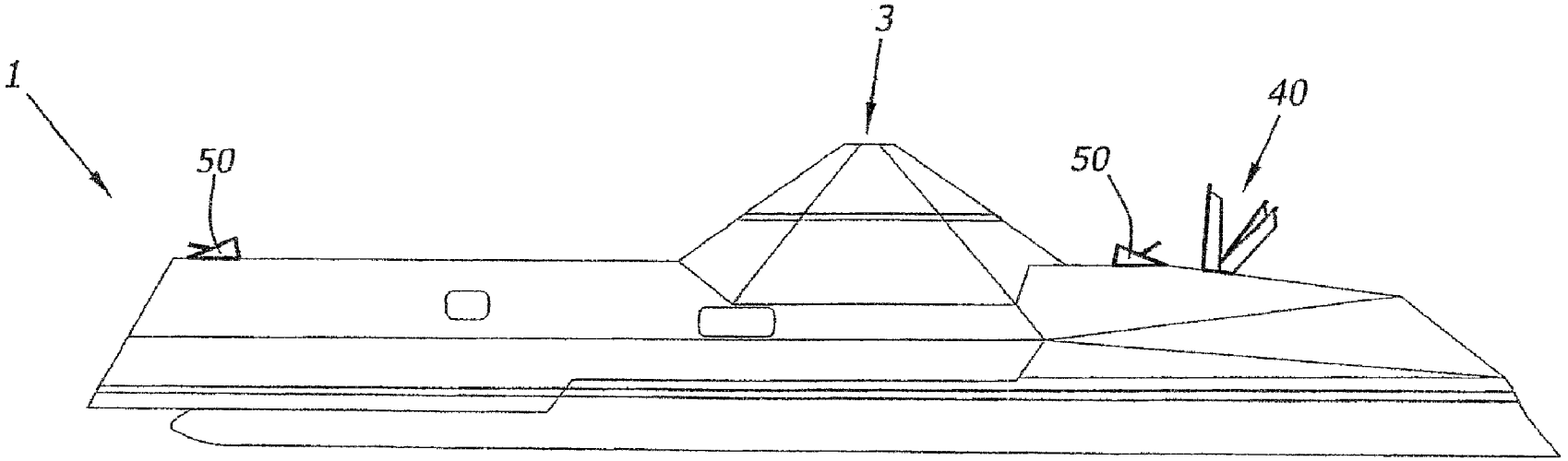
Figure 4:
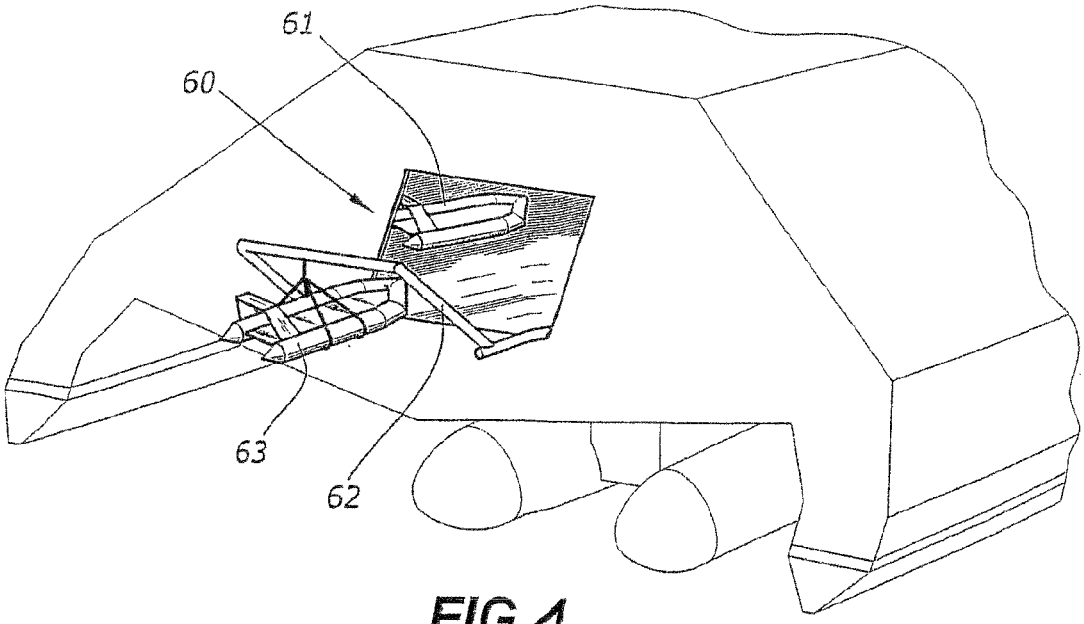
Figure 5:
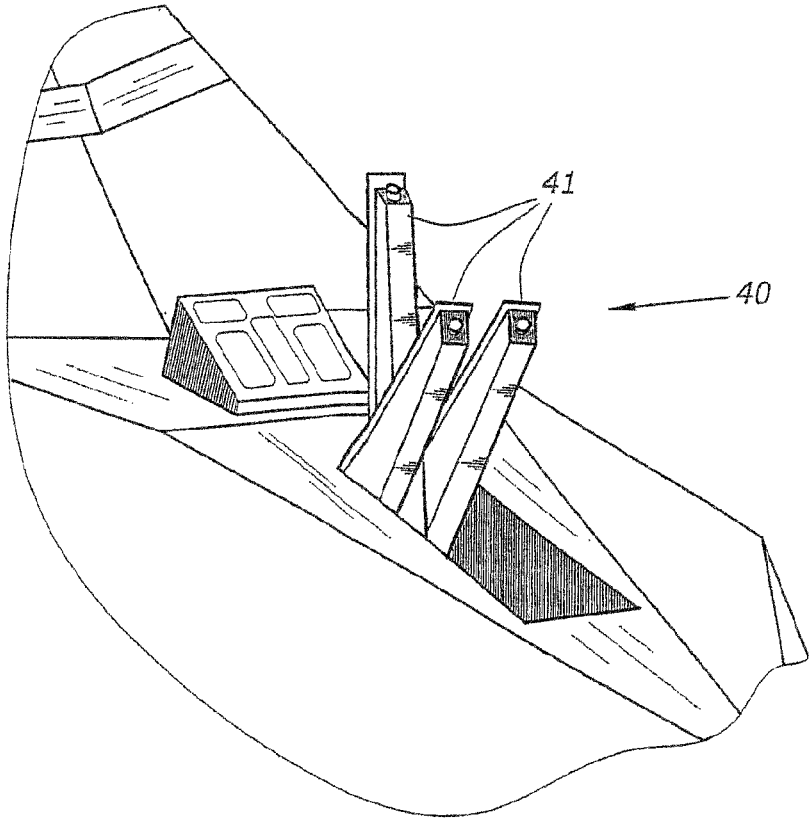
Figure 8:
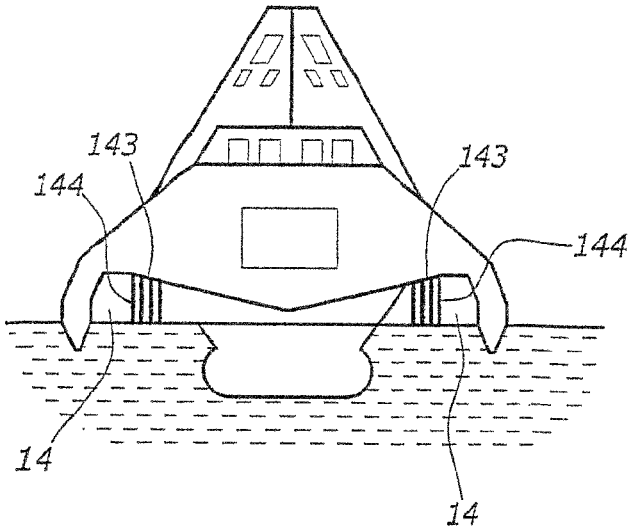
Figure 9:
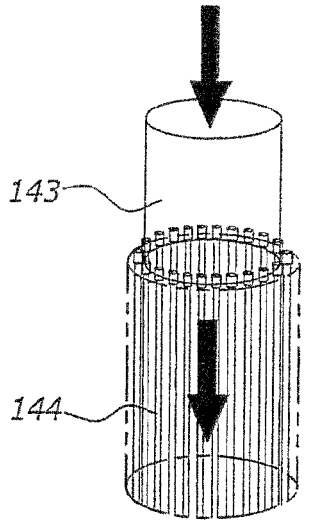
Figure 10:
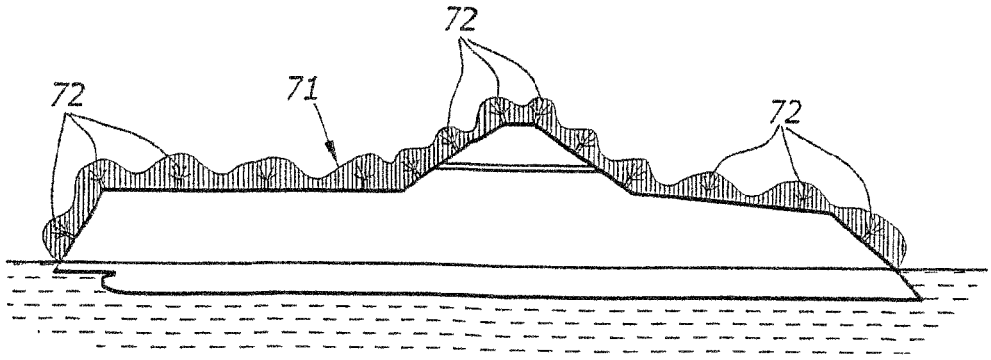
Figure 11:
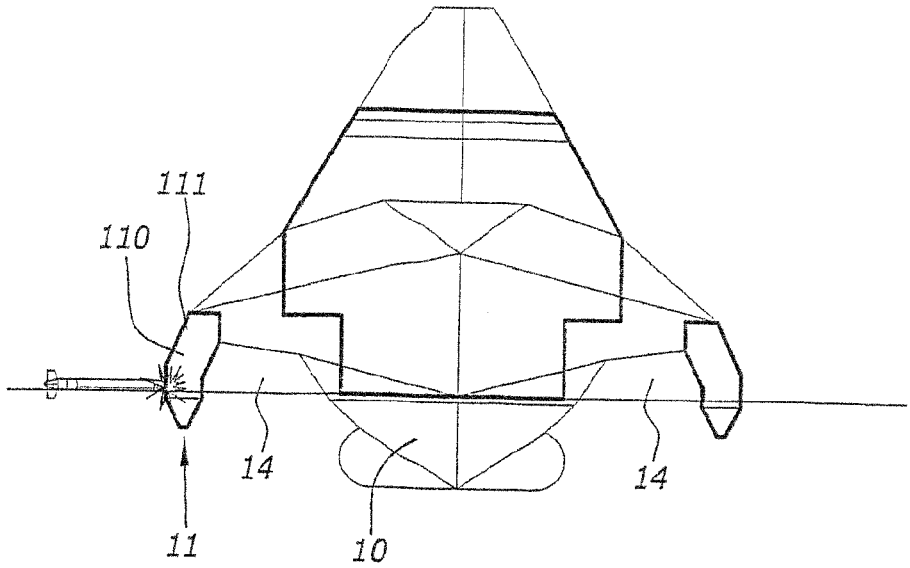
Figure 12:
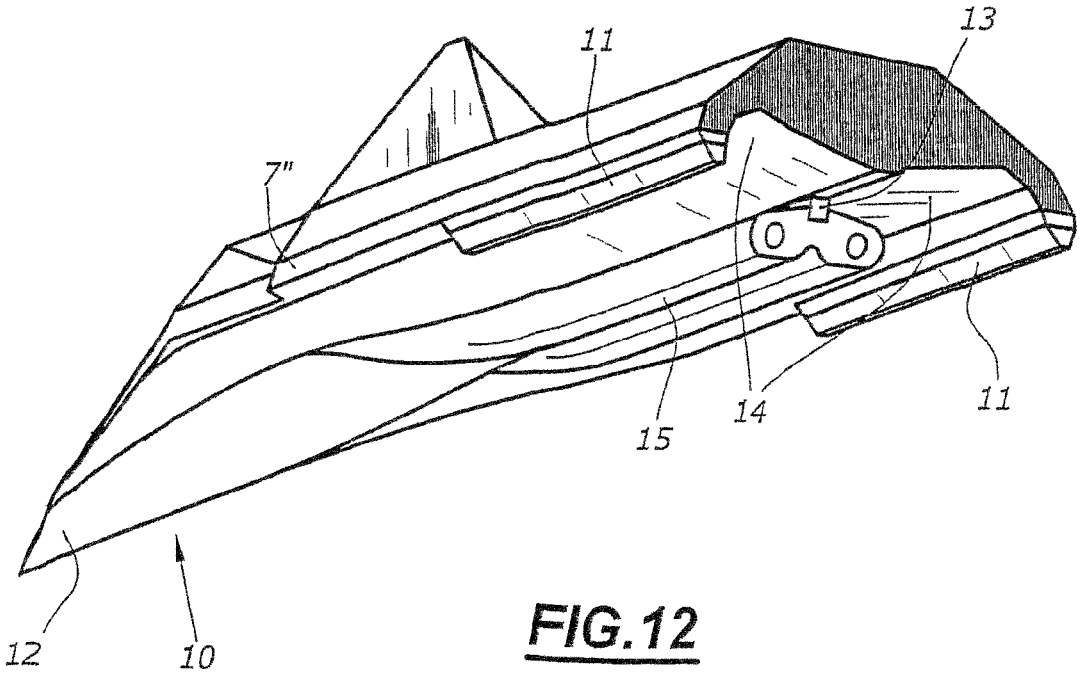
Figure 13:
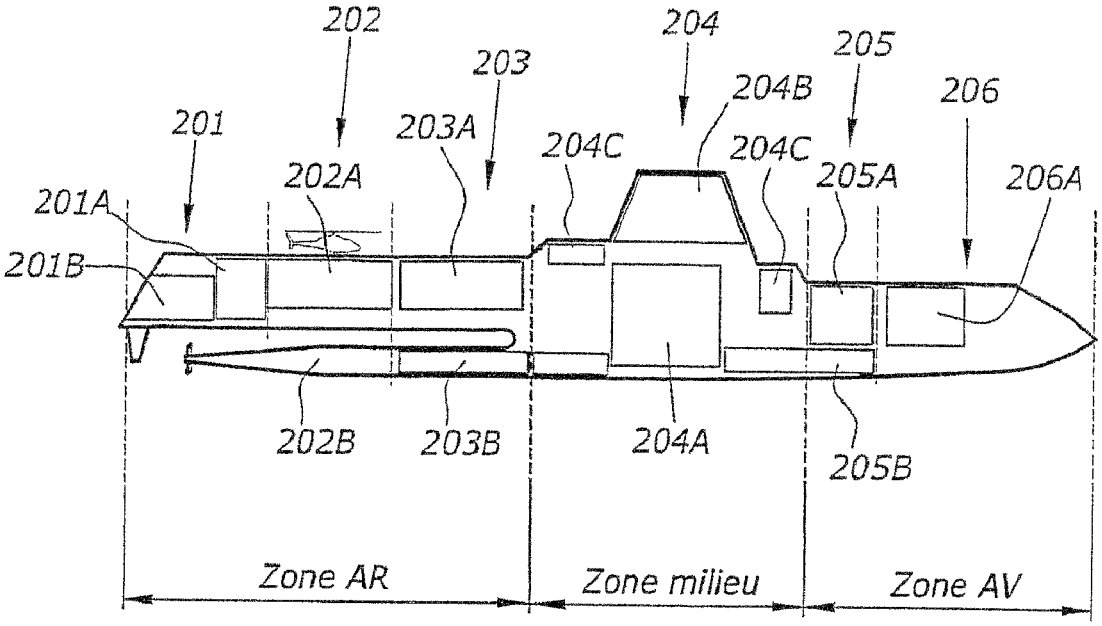

FIGS. 2A, 2B, and 2C are views respectively in profile, from above, and end-on of a stealth armed ship;

FIG. 3 is a profile view of a stealth armed ship with its weapons systems deployed;

FIG. 4 is a view of the stern of the stealth armed ship, showing a device for launching a watercraft;

FIG. 5 is an enlarged perspective view of the bow portion of a stealth armed ship having one of its weapons systems deployed;

FIG. 6 is a diagrammatic view of an integrated self-defense turret firstly in the retracted position, and secondly in the in-service position;

FIGS. 7A and 7B are views respectively of the bow and of the stern of a stealth ship of the trimaran type provided with curtains of water for closing off the tunnels situated between the hulls;

FIG. 8 is a diagrammatic end view of a ship provided with means for concealing the outlets of the hot gas exhaust ducts;

FIG. 9 is a diagrammatic view of the device for concealing streams of hot gases exiting from an exhaust duct;

FIG. 10 is a diagrammatic profile view of a stealth armed ship including means for generating enshrouding mists of water;

FIG. 11 is a diagrammatic end view of a stealth armed vessel of the trimaran type provided with ballast compartments that perform shielding functions;

FIG. 12 is a perspective view from below of the immersed portion of the hull of a stealth armed ship; and FIG. 13 is a diagram showing a possible fitting-out configuration for a stealth armed ship.

Figure 1A:
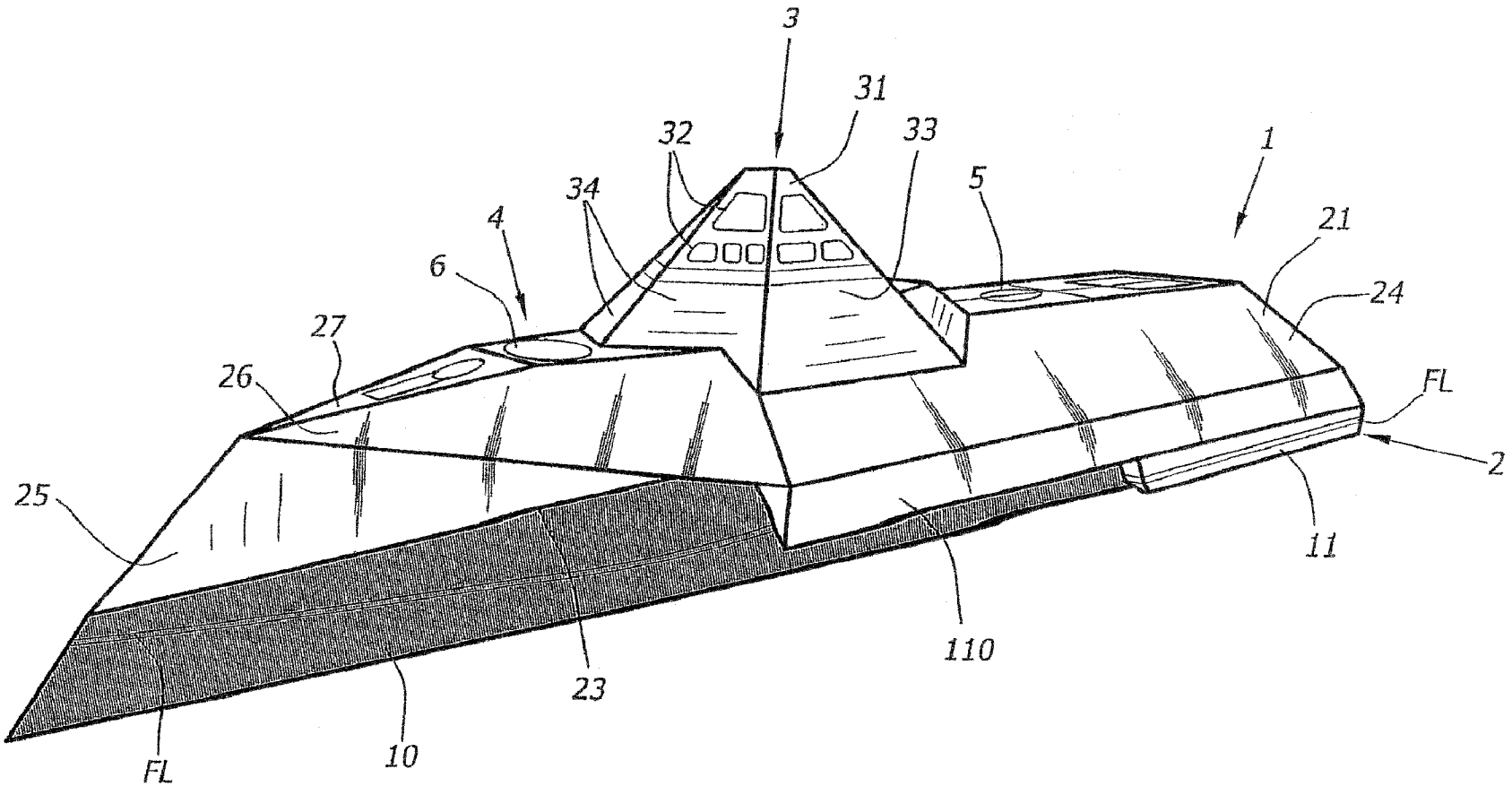
FIG. 1A is a perspective view of a stealth armed ship.

The armed ship designated by overall reference 1 in FIG. 1A, e.g. a frigate having a displacement of about 7000 metric tonnes, is a ship that is designed to have particularly high stealth. This ship conventionally comprises a hull 2 above which a superstructure 3 is disposed. This ship can be divided on a horizontal plane corresponding to the waterplane (not shown in the figure) into firstly upperworks which are constituted by the upper portion 21 of the hull and by a superstructure 3, and secondly the lower portion of the hull 22 that lies below the waterline.

Figure 1B:
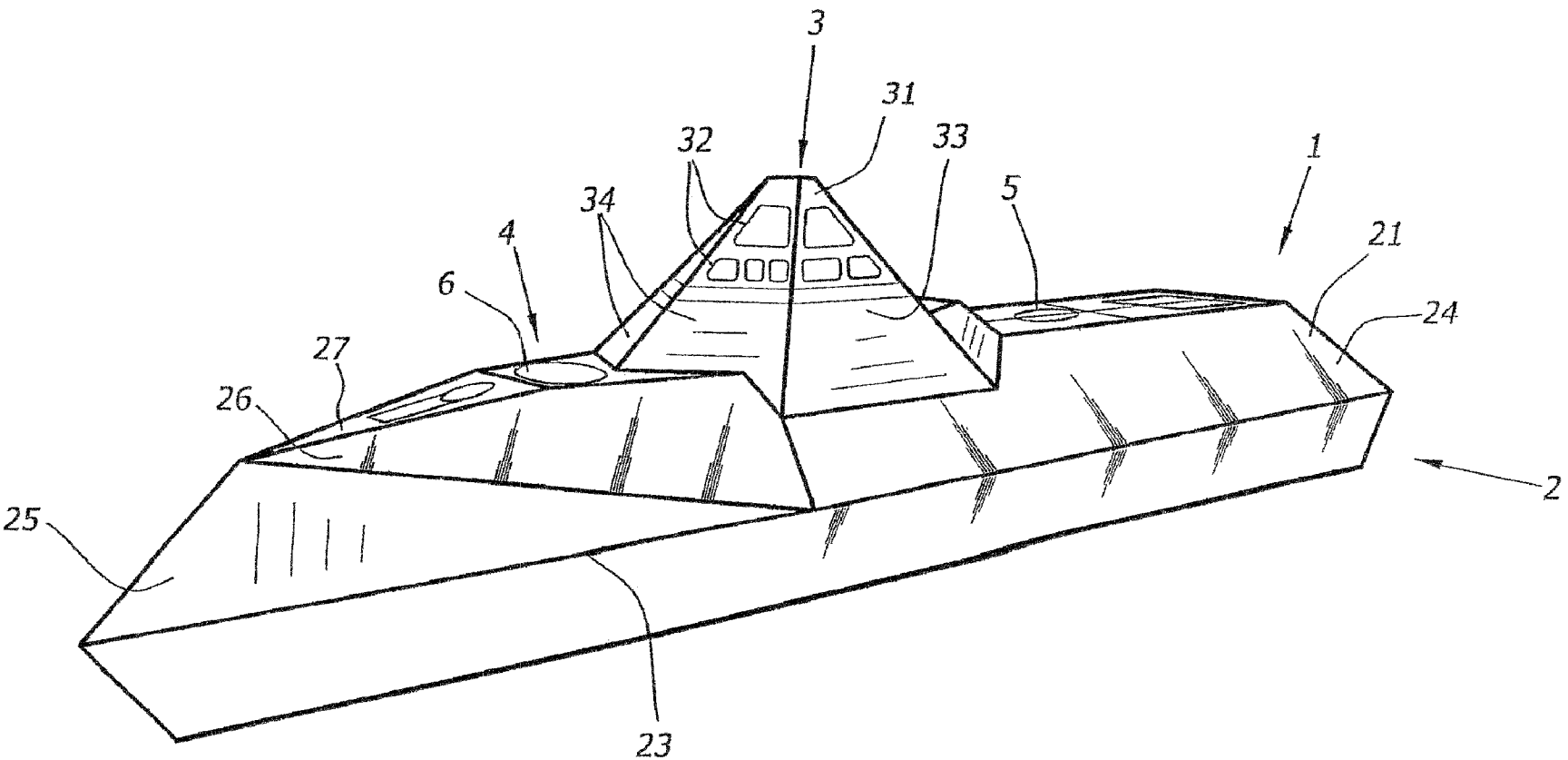
FIG. 1B is a perspective view of a stealth armed ship.

FIG. 1B also shows a stealth armed ship that has upperworks that are substantially identical to the upperworks of the ship of FIG. 1A, but that differ therefrom by the shape of the hull. In the figures, corresponding elements bear like references.

The upperworks of the two ships are described simultaneously below, and then the hull of the ship of FIG. 1A is described specifically since that hull is a special hull, whereas the hull of the FIG. 1B ship is conventional.

The upperworks of the ship are defined by an outer casing designated by overall reference 4, which outer casing is constituted by the freeboard sides of the hull, by the decks 5 and 6, and by the side walls of the superstructure 3. The outer casing of the upperworks is constituted by plane panels that are inclined inwards relative to the vertical so that their outside faces face upwards, while forming angles $\alpha$, $\beta$, and $\gamma$ (FIG. 2C) that are greater than 20° relative to the vertical for the faces situated in the lower half of the hull below a line 23. These walls that are inclined at greater than 20° descend to less than 2 m and preferably less than 1 m above the waterline, and can descend to the waterline, or indeed to below the waterline in certain portions of the ship. The top half of the hull defined by the line 23 is constituted by plane panels such as the panels 24, 25, 26, and 27 that are inclined relative to the vertical at angles $\beta$ that are greater than 50°. On the upper portion of the hull, the ship has horizontal decks 5, and 6 that extend in continuity with the side walls of the hull. Above the hull, a superstructure 3 is disposed whose walls constitute the upper portion of the outer casing of the upperworks of the ship. This superstructure is in the form of a pyramid made up of plane panels 33, 34 inclined inwards relative to the vertical in a manner such that their outside faces face upwards at angles $\gamma$ greater than 30°.

As shown in FIGS. 1A, 1B, 2A, 2B, and 2C, the plane panels making up the outer casing of the upperworks of the ship are defined by lines that all form angles relative to the vertical that are greater than 20°. These lines can optionally be horizontal.

It should be noted that, for reasons of geometrical shape of the hull, the panels of the upperworks cannot, in general, all be inclined inwards from a line situated at less than one meter above the waterline, although that would be possible with certain configurations, e.g. of the catamaran type.

However, the inventors have observed that good electromagnetic stealth can be obtained even if the hull has panels that are inclined inwards slightly only, or indeed that are inclined outwards, provided that said panels do not extend above a line situated 5 m above the waterline, and provided that they extend over less than 50% of the length of the hull, and preferably over less than ⅓ of the length of the hull.

The ship tapers towards the bow and is more rectangular going towards the stern. It has an aft deck 5 that is sufficiently large to receive, for example, a helicopter.

The hull 2 of the ship of FIG. 1A is of the trimaran type and it comprises a main float 10 and two side floats 11. The hull 2 of the ship of FIG. 1B is of the single-hull type.

As can be seen in the figures, the ship essentially comprises a hull and an outer casing that have no marked unevenness, as explained below. The ship is equipped with means that are or that can be concealed in full by being brought out of sight within the outline of the outer casing of the upperworks.

The ship is provided with sensors and transmitters such as, for example, communications antennae, radars and any items of equipment of electromagnetic type including antennae, which are all either disposed inside a preferably pyramidal radome 31 that is situated on the upper portion of the superstructure 3, or constituted by flat antennae 32 that are disposed on the walls 33, 34 of the upper portion of the superstructure, and that come to be embedded in said walls. The ship can be provided with sensors disposed in a radome and with sensors on the walls. In addition, the sensors incorporated in the walls can be incorporated not only into the high portion of the superstructure, but also into the low portion of the superstructure and also into the non-immersed walls of the hull.

The pyramid-shaped superstructure can have rounded walls, in particular in its upper portion, provided that such upper walls do not have faces that face downwards.

In addition, in its lower portion, the superstructure houses the bridge of the ship. The bridge is of the "360° vision" type, i.e. it makes it possible to see in all directions and it has control stations facing not only towards the bow, but also towards the sides and towards the stern. This configuration is particularly effective when the bridge is overhanging relative to the exterior deck and when no other superstructures exist that might obstruct the view.

Similarly, the ship has weapons systems (FIG. 3) constituted, for example, by long-range guns 40 that can be either concealed under the bow deck area 27 or deployed above said bow deck area. These weapons can also be retractable self-defense turrets 50 situated at the bow or at the stern of the ship, e.g. under deck 5 or under deck 6, and that can be brought out of sight within the outer casing of the upperworks of the ship or deployed beyond said outer casing, so as to be put into service.

The long-range guns designated by overall reference 40 are shown in enlarged manner in FIG. 5 and, for example, there are three of them. The guns, surrounded by trim enabling them to be fully concealed beneath the wall of the outer casing of the upperworks, are mounted to pivot at their bases between an out-of-sight position in which they lie substantially within the outer casing of the upperworks, and an active position in which they point upwards at a significant angle. Optionally, they can be put into the vertical position so that they can be reloaded from inside the ship.

The self-defense turrets 50 are shown diagrammatically in FIG. 6 firstly in a retracted position, and secondly in an in-service position. These turrets 50 are wedge-shaped in overall shape, and are hinged about a horizontal axis 51 enabling them to pivot between a retracted position 52 and an in-service position 53. In the retracted position 52, the top face 54 of the turret is flush with the deck of the ship or with the wall of the upperworks into which it is integrated. In the in-service position, the turret projects beyond the deck of the ship. The turrets conventionally carry self-defense weapons 55 which are, for example, rapid-fire guns or any other items of equipment known to the person skilled in the art that can be brought out of sight into the turret.

The ship can also be provided with means for launching missiles and/or means for launching torpedoes, which means are concealed within the outline of the outer casing of the upperworks in which suitable trapdoors are provided. Such means are known to the person skilled in the art.

The ship also has internal compartments, each of which can open to the outside via at least one door integrated in a panel of the outer casing of the upperworks. In particular, a compartment 60 disposed at the stern can open via a retractable door 61 disposed in the stern of the ship. A deployable gantry davit 62 makes it possible to launch a watercraft 63 or to bring it back on board. Such a compartment can also be disposed in a manner such that its door opens onto the sides of the ship.

On the aft deck 5, which is sufficiently large to receive a helicopter, the ship also has a trapdoor making it possible to retract a helicopter into a hangar situated under the deck.

As can be seen in the figures, the ship can operate with all of the items of equipment retracted and camouflaged within the outline of the outer casing of the upperworks. Said items can be items that are camouflaged permanently, such as the radars or antennae, or items that project or are visible from the outside only while they are being used, as applies to the weapons system or to any other load-handling system for launching watercraft and for bringing them back on board. Because the outer casing of the upperworks of the ship is constituted only by plane panels that are inclined to large extents and that have no projecting elements, the ship has extremely high electromagnetic stealth since it has an electromagnetic signature that is indistinguishable from the background noise.

It should be noted that, in order to improve the stealth of the ship, i.e. in order to make it more difficult to identify in its surrounding environment, certain provisions have been made: in particular the bow and the stern of the ship have lines that, seen in profile, are approximately symmetrical about the central axis of the ship, and the superstructure is in the central third of the ship, approximately mid-way along the ship.

It can be observed that the silhouettes of the ship as seen from the bow, in profile, or from the stern are almost identical.

These geometrical characteristics impart stealth to ship not only as regards electromagnetic detection but also as regards visual detection.

In order to improve the stealth still further, the ship can be enshrouded in a mist of water 71 generated by a plurality of water spray nozzles 72 that are disposed over the entire upperworks. These water mist nozzles make it possible, if so desired, to cool the outer walls of the ship, thereby participating in managing the infrared signature of said ship. In addition, in particular when the horizon is a little hazy, the mist of water that surrounds the ship reduces its optical visibility and reduces the contrast of the ship, in particular for the infrared domain, relative to the surrounding environment.

In addition, the outer walls of the upperworks of the ship can be made of or covered with materials having specific functions. Such materials can, for example, be materials that absorb radar waves, materials that absorb infrared radiation, in particular in band 2 (in the range 3 micrometers (μm) to 5 μm) and in band 3 (in the wavelength range 8 μm to 12 μm), or indeed decharacterization materials such as thermochromic or electrochromic paints. The person skilled in the art knows about such materials having specific functions, and can choose them as a function of needs, on a case-by-case basis.

The ship as shown in FIG. 1A is a multi-hull ship, e.g. a trimaran ship comprising a main float 10 flanked by two balancing side floats 11, the side floats 11 co-operating with the main float 10 to define two tunnels 14 extending longitudinally under the hull.

The side floats 11 include respective keels 110 that extend towards the bow of the ship into register with the central portion of the ship, in which portion the crew living quarters are installed.

Facing these living quarters, the keels of the side floats are constituted by ballast compartments that can be filled with water in order to constitute shields or protections against aggression from a missile or from a suicide boat.

In order to improve thermal stealth or, more exactly, infrared stealth, in band 2 and band 3, the exhaust gases from the internal combustion engines with which the ship is equipped are discharged into the tunnels 14 situated between the main float 10 and the side floats 11. In order to improve the thermal stealth even further, the gases can be confined inside the tunnels situated under the lower portion of the hull of the ship by curtains of water 140 at the stern ends 140 and at the bow ends 141, which curtains are generated by nozzles forming vertical jets of water that are situated side-by-side and that form a screen for the hot gases at the inlets and at the outlets of the tunnels situated between the floats. Said jets of water can be obtained by pumping in seawater and by discharging it directly or optionally after adding a surfactant compound, e.g. a polymer, to it. These curtains of water also offer the advantage of forming screens to radar waves.

The thermal stealth can also be improved by channeling the exhaust gases at each of the outlets of the exhaust ducts 143 that open out in the top faces of tunnels situated between the floats, this channeling being achieved by means of an artificial "duct" 144 made up of jets of water delivered by nozzles disposed at the periphery of each outlet of the exhaust duct.

The artificial duct 144 channels the exhaust gases from the exhaust duct to the surface of the water on which the ship is floating. Said gases can then be diluted in said water.

It should be noted that, even when the ship does not have a hull of the multi-hull type, it is possible to provide tunnels in order to discharge the exhaust gases discreetly.

In order to improve the acoustic stealth, the ship is propelled by a fuel-burning power source, e.g. a diesel engine or a turbine, that is disposed above the waterline and that delivers electrical power to electric motors for driving the shafts that carry the screws or propellers for driving the ship. With this feature, in which no noisy equipment is disposed under the waterline, the noise transmitted to the water is limited.

The main float can have a bow portion 12 that is relatively wide and that is extended aft at waterline level by a narrow portion 13, and, at its lower portion, by one or two stern bulbs 15 so that the center of flotation of the hull is situated forward of the center of buoyancy of the hull, and the distance between the center of flotation and the center of buoyancy is greater than 5% of the length of the waterplane. Preferably, the center of flotation is situated in the bow half of the hull, and the center of buoyancy is situated in the stern half. With this particular and preferred configuration, the ship offers the advantage both of being capable of accommodating major fitting-out, and also of having very good pitch stiffness.

In particular when it has a hull as shown in FIG. 1A and as described above, the above-described ship offers the advantage of being capable of accommodating numerous installations. By way example, FIG. 13 shows possible installations with which such a ship can be fitted out.

Starting from the stern and going forwards, the ship has a weapons and watercraft zone that can be provided with a retractable self-defense turret 201A, and with a shed 201B for watercraft that can be launched via the stern.

Then the ship has a zone 202 that is an engine zone in which the portion situated above the waterline contains noisy internal combustion engines 202A and the lower portion situated in the bulb contains, for example, an electric motor 202B for driving the screw for propelling the ship.

A third zone 203 has, in its upper portion, a hangar 203A, e.g. for a helicopter, and storage bays 203B situated in the lower portion corresponding to the bulb.

A central zone 204 corresponding approximately to the central third of the ship firstly has crew living quarters 204A and secondly installations 204B designed for controlling the ship and for controlling operations. In this zone, it is also possible to provide retractable weapons 204C, e.g. retractable self-defense turrets or retractable missile launch pads.

In the bows, a second engine zone 205 contains engines 205A situated above the waterline also to avoid transmitting noise directly to the water, and, below the waterline, storage bays 205B.

Finally, further forwards, a zone 206 contains retractable weapons 206A, and in particular retractable long-range guns, and optionally a retractable self-defense turret, or retractable torpedo launch tubes.

The ship as described above is a ship that has particularly high stealth, so that the signals that could be used in an attempt to detect it remain indistinguishable from the signals of the same type corresponding to its surrounding environment. Such stealth is obtained for the electromagnetic field, for the thermal detection field, for the optical field, or even for the acoustic field.

When the ship uses an immersed hull configuration as described above, it also offers the advantage of having a small wake which also makes it even more difficult to detect.

The installations with which the ship is fitted out are given in the description merely by way of indication. Any other fitting-out configuration is possible for the ship.

Finally, this design of ship can be used for ships of relatively large tonnage, and in particular for frigates. As shown in FIGS. 1A and 1B, the ship can be of the trimaran type or of the single-hull type, but other types of hull are possible. It should, however, be noted that one of the means of obtaining stealth is the large amount of tumblehome given to the ship, and it is known to the person skilled in the art that a conventional single-hull ship that has a large amount of tumblehome is highly roll-unstable. Thus, in order to obtain very good stealth, it is desirable to use a multi-hull design, thereby making it possible to obtain both roll-stability and a large amount of tumblehome.

In addition, all or some of the hull and of the outer casing of the upperworks can be made of composite panels made up, for example, of balsa boards sandwiched between sheets of resin reinforced with glass fibers or with carbon fibers. Such materials, known to the person skilled in the art, can also be adapted to absorb electromagnetic waves. In view of the features provided for imparting electromagnetic stealth, the ship can have stealth in the band from 10 megahertz (MHz) to 100 gigahertz (GHz), and in particular for broadband radars, i.e. radars working in the band from 1 GHz to 25 GHz.

The invention claimed is:

1. A stealth armed surface ship (1) comprising:

a hull (2), at least one deck (5, 6);

an outer casing of an upperworks formed by walls (24, 25, 26, 27, 33, 34) of an upper portion of the hull and at least one superstructure (3), wherein the superstructure is disposed in the central third of the length of the hull in a manner such that the superstructure is substantially centered along the length, and wherein the angles of the bow lines and of the stern lines are symmetrical about the middle of the hull;

lower wall portions defined by wall portions of the walls between a line situated less than one meter above a waterline to five meters above the waterline;

upper wall portions defined by wall portions of the walls at least five meters above the waterline;

the upper wall portions are inclined inwards so that outside faces of the upper wall portions face upwards at angles relative to vertical that are greater than or equal to 20°;

at least over 50% of the length of the ship comprises the lower wall portions inclined inwards so that outside faces of the lower wall portions face upwards at angles relative to vertical greater than 20°; and sensors, transmitters, weapons, and optionally a load-handling means, wherein the sensors and transmitters, the weapons, and the load-handling means are concealed or concealable in or beneath the outer casing of the upperworks.

2. A ship according to claim 1, wherein at least over two-thirds of the length of the ship comprises the lower wall portions inclined inward so that the outside faces of the lower wall portions face upwards at an angle relative to vertical greater than 20°.

3. The ship according to claim 1, wherein the portion of the outer casing (4) that corresponds to the upper half of the hull (21), including the bow and the stern, is constituted by the upper wall portions (24, 25, 26) that are all inclined inwards at angles relative to vertical greater than 50°.

4. The ship according to claim 1, wherein the portion of the outer casing (4) that corresponds to the superstructures (3) is constituted by walls (33, 34) that are all inclined inwards at angles relative to vertical greater than 30°.

5. The ship according to claim 1, wherein the walls (24, 25, 26, 27, 33, 34) making up the outer casing (4) of the upperworks are plane panels, and in that the junction lines along which two adjacent panels meet are straight.

6. The ship according to claim 1, wherein the superstructure (3) is constituted by a pyramid that preferably has at least 4 facets, and in that the sensors and the transmitters are housed and concealed under a radome (31) that constitutes at least one of a top of the superstructure and plane panels (32) that are incorporated in the walls of the superstructure.

7. The ship according to claim 1, wherein the superstructure houses the bridge of the ship.

8. The ship according to claim 7, wherein the bridge has 360° visibility.

9. The ship according to claim 1, further comprising:

at least one internal compartment (60) that can open to the outside via at least one door (61) integrated in a panel of the outer casing of the upperworks, the compartment is equipped with a deployable gantry (62) making it possible to launch an object and to bring the object back on board.

10. The ship according to claim 1, further comprising:

at least one weapon chosen from among a retractable long-range gun (40), a retractable self-defense turret (50), a retractable missile launch device, and a retractable torpedo launch device.

11. The ship according to claim 1, wherein at least one deck (5) has a sufficiently large area to receive an aircraft and optionally means for retracting at least one aircraft into a hangar under the deck.

12. The ship according to claim 1, further comprising:

a set of nozzles (72) making it possible to generate a mist (71) enshrouding the upperworks.

13. The ship according to claim 1, wherein the hull (2) includes at least two parallel floats (10, 11) defining a tunnel (14) between them, the walls of the tunnel extending downwards at angles relative the vertical that are greater than 20°, and in that the ship includes at least one fuel-burning power source discharging combustion gases, and in that the combustion gases are discharged into at least one tunnel (14) defined by two parallel floats.

14. The ship according to claim 13, wherein at least one tunnel (14) is closed at its bow end and at its stern end by respective curtains of water (140, 141) in order to form a screen to radar waves and in order to trap the hot exhaust gases.

15. The ship according to claim 13, wherein the exhaust gases are discharged via at least one exhaust duct (143) whose outlet is provided, at its periphery, with means for generating a shroud (144) constituted by jets of water for channeling the exhaust gases to the surface of the water on which the ship floats.

16. The ship according to claim 13, wherein it has a central main float (10) and at least two stabilizer side floats (11).

17. The ship according to claim 16, wherein at least one side float (11) includes a keel (110) extended at least above the water into register with the living quarters of the ship, and in that, at least in register with the living quarters of the ship, the keel contains a ballast compartment (111) that can be filled with water in order to constitute shielding.

18. A stealth armed surface ship comprising:

a hull, at least one deck;

an outer casing of an upperworks formed by walls of an upper portion of the hull and at least one superstructure;

lower wall portions defined by wall portions of the walls between a line situated less than one meter above a waterline to five meters above the waterline;

upper wall portions defined by wall portions of the walls at least five meters above the waterline;

the upper wall portions are inclined inwards so that outside faces of the upper wall portions face upwards at angles relative to vertical that are greater than or equal to 20° , at least over 50% of the length of the ship comprises the lower wall portions inclined inwards so that outside faces of the lower wall portions face upwards at angles relative to vertical greater than or equal to 20°; and sensors, transmitters, weapons, and optionally a load-handling means, wherein the sensors and transmitters, the weapons, and the load-handling means are concealed or concealable in or beneath the outer casing of the upperworks, wherein the center of flotation of the hull is situated forward of the center of buoyancy of the hull, and in that the horizontal distance between the centre of buoyancy and the center of flotation is greater than 5% of the length of the waterplane of the hull.

19. The Ship according to claim 1, wherein at least the hull is made up of non-metallic panels of composite material.

20. The ship according to claim 1, wherein at least one wall of the upperworks is made of or coated with a material having a specific function, in particular of the type absorbing radar waves and/or absorbing infrared radiation, and/or being decharacterizing relative to the surrounding environment.

21. The ship according to claim 1, further comprising:

at least on of sensors and transmitters concealed beneath the walls or incorporated into the walls of the upperworks below the superstructure.

22. The ship according to claim 1, the ship constitutes a frigate.

* * * * *